US008948440B2

(12) United States Patent
Lin

(10) Patent No.: US 8,948,440 B2
(45) Date of Patent: Feb. 3, 2015

(54) ELECTRO-ACOUSTIC TRANSDUCER

(71) Applicant: Cheng Uei Precision Industry Co., Ltd., New Taipei (TW)

(72) Inventor: You Ruei Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 76 days.

(21) Appl. No.: 13/891,320

(22) Filed: May 10, 2013

(65) Prior Publication Data

US 2014/0334662 A1 Nov. 13, 2014

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 1/02*** | (2006.01) |

(52) U.S. Cl.

CPC ..... *H04R 1/02* (2013.01)
USPC ..... 381/418; 381/412; 381/419

(58) Field of Classification Search

CPC ..... H04R 11/00; H04R 11/02
USPC ..... 381/396, 398, 412, 418–419
See application file for complete search history.

(56) References Cited

U.S. PATENT DOCUMENTS

2011/0243366 A1* 10/2011 Carlmark et al. ..... 381/398

* cited by examiner

*Primary Examiner* — Matthew Eason
(74) *Attorney, Agent, or Firm* — WPAT, P.C.; Anthony King; Kay Yang

(57) ABSTRACT

An electro-acoustic transducer includes a frame with an accommodating space defined therein and an opening opened in a top surface thereof, at least one driving unit equipped in the accommodating space of the frame, a diaphragm movably mounted at the opening of the frame, at least one fulcrum settled in the accommodating space of the frame, and at least one lever placed next to the fulcrum to contact with and use the fulcrum as rotation center thereof. The lever connects with the driving unit and the diaphragm at two ends thereof and transmits vibration wave from the driving unit to the diaphragm. The lever has a longer length from the fulcrum to the diaphragm than from the fulcrum to the driving unit for increasing the vibration stroke of the diaphragm during transmitting the vibration wave.

5 Claims, 5 Drawing Sheets

ELECTRO-ACOUSTIC TRANSDUCER

BACKGROUND OF THE INVENTION

1. Field of the Invention

This invention relates to a transducer, especially to an electro-acoustic transducer.

2. The Related Art

Referring to FIG. 1, an electro-acoustic transducer 10' is a kind of device for converting electric energy into acoustic energy, and often known as loudspeakers. The electro-acoustic transducer 10' includes a driving unit 20' and a diaphragm 30' connected with the driving unit 20'. The driving unit 20' may come in various forms, and in this embodiment it includes a field magnet 22' and a voice coil 24'. The field magnet 22' is fixed inside the electro-acoustic transducer 10' to provide a stable magnetic field, and the voice coil 24' is movably mounted at a cylindrical gap of the magnetic field and connected with an external signal source. So when an external signal current is applied to the voice coil 24', the voice coil 24' will generate a magnetic force and vibrate the diaphragm 30' back and forth axially so as to pressurize the surrounding medium (such as air) to generate a sound wave.

With the description above, it is obvious to know that the performance of the electro-acoustic transducer 10' is determined by the ability of pressurizing the medium, and the ability of pressurizing the medium is directly proportional to the surface area and the vibration stroke of the diaphragm 30'. When the vibration stroke of the diaphragm 30' is longer and the surface area of the diaphragm 30' is bigger, the quantity of pressurized medium will be increased too. However, it will cause the radius and the depth of the electro-acoustic transducer 10' to be increased. So the electro-acoustic transducer 10' in small size can only pressurize less quantity of medium and has poor performance in general, and the electro-acoustic transducer 10' with better performance is larger in size relatively.

Therefore, in the trend of portability and miniaturization, the electro-acoustic transducer 10' made with conventional structure is more and more difficult to satisfy both the requirements of good performance and miniaturized size. So, an electro-acoustic transducer capable of overcoming the foregoing problems is required.

SUMMARY OF THE INVENTION

An objective of this invention is to provide an electro-acoustic transducer that satisfies both the requirements of good performance and miniaturized size.

In order to achieve said objective, the electro-acoustic transducer in this invention includes a frame with an accommodating space defined therein and an opening opened in a top surface thereof, at least one driving unit equipped in the accommodating space of the frame, a diaphragm movably mounted at the opening of the frame, at least one fulcrum settled in the accommodating space of the frame, and at least one lever placed next to the fulcrum to contact with and use the fulcrum as rotation center thereof. The lever connects with the driving unit and the diaphragm at two ends thereof and transmits vibration wave from the driving unit to the diaphragm. The lever has a longer length from the fulcrum to the diaphragm than from the fulcrum to the driving unit for increasing the vibration stroke of the diaphragm during transmitting the vibration wave.

As described above, the electro-acoustic transducer in this invention increases the vibration stroke of the diaphragm by adjusting the proportion of the length from the fulcrum to the diaphragm and the length from the fulcrum to the driving unit, so as to increase the ability of pressurizing surrounding medium without increasing the surface area of the diaphragm and the depth of the driving unit. So the electro-acoustic transducer in this invention can satisfy both the requirements of good performance and miniaturized size.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
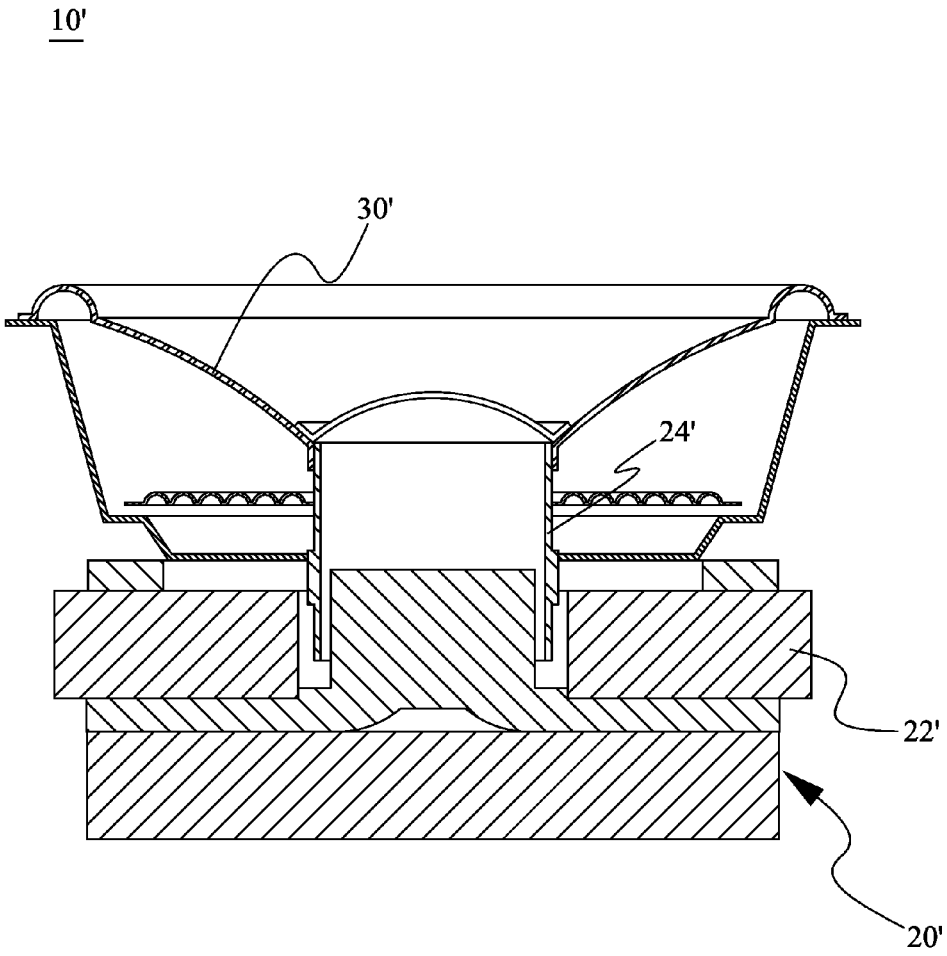
(Prior Art) FIG. 1
FIG. 1 is a cross-sectional view of a conventional electro-acoustic transducer.
Figure 2:
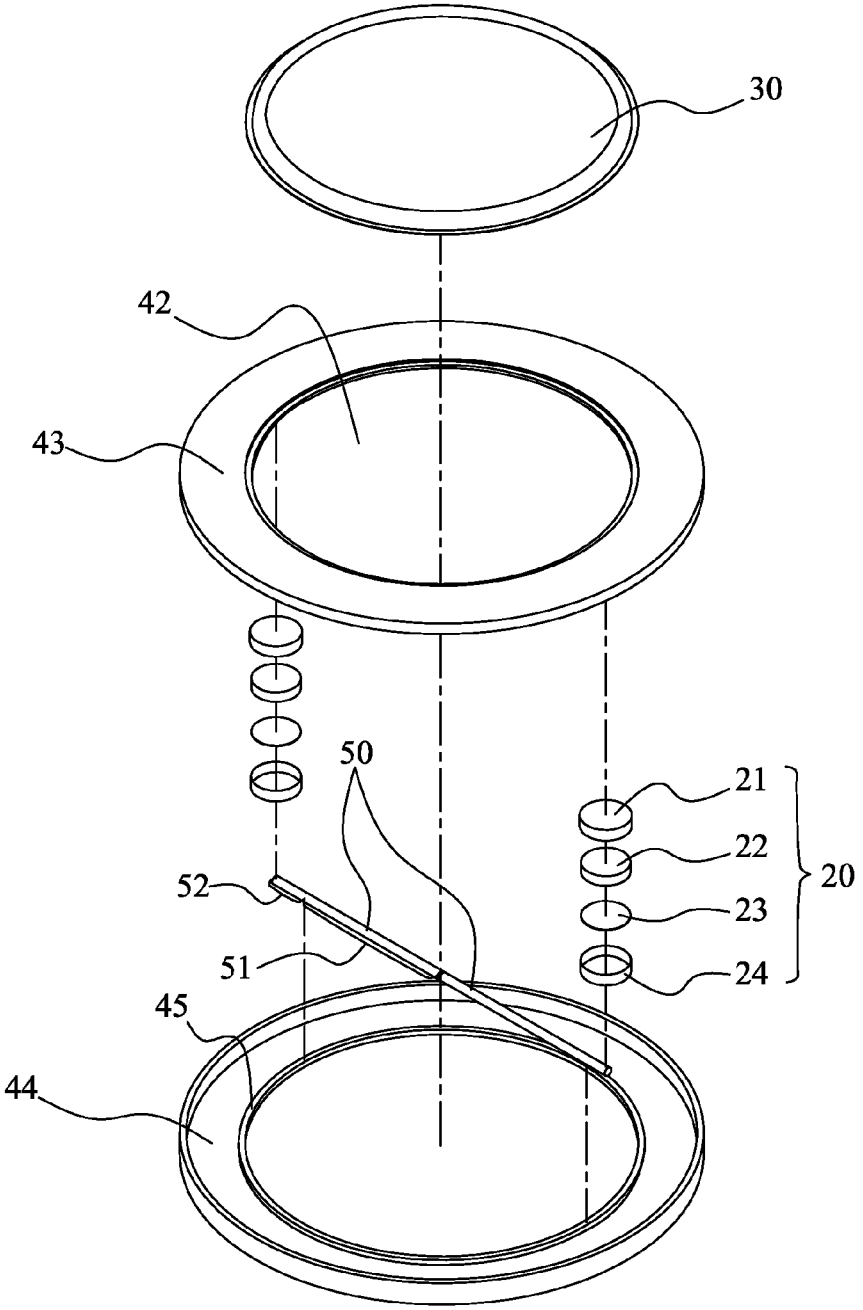
FIG. 2 shows an exploded perspective view of an electro-acoustic transducer in this invention.
Figure 3:
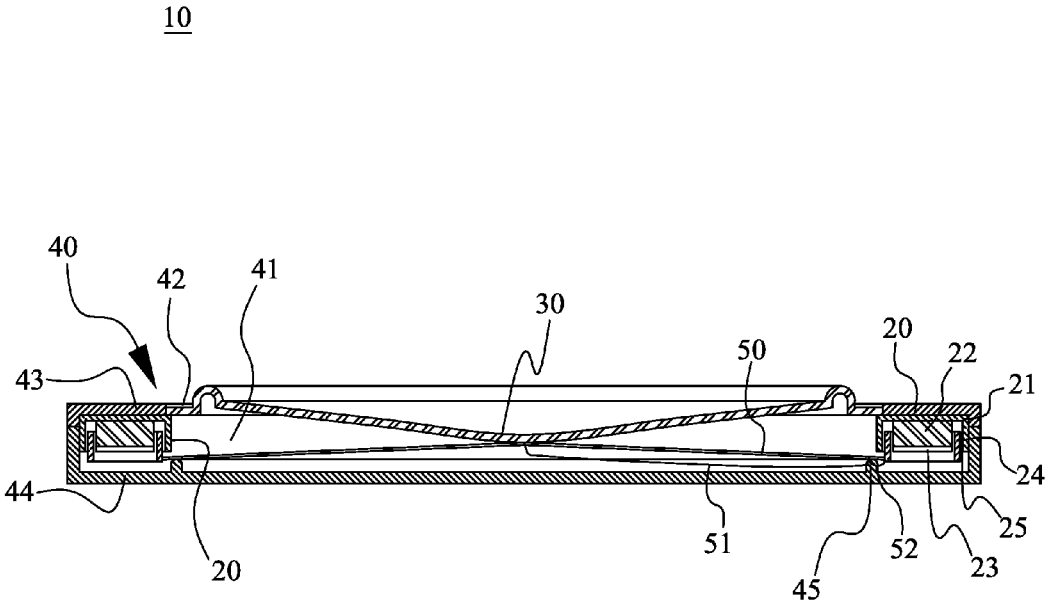
FIG. 3 shows a cross-sectional view of the electro-acoustic transducer in this invention.

Referring to FIG. 2 and FIG. 3, an electro-acoustic transducer 10 in this invention includes a frame 40, two driving units 20, a diaphragm 30, a fulcrum 45 and two levers 50. The frame 40 includes a base 44 and a cover 43 matched with each other to define an accommodating space 41 inside the frame 40. An opening 42 is opened in a top surface of the cover 43. The driving units 20 are equipped at two opposite sides of the accommodating space 41 and connected with an external signal source. The diaphragm 30 is movably mounted at the opening 42 of the cover 43. The fulcrum 45 is protruded upward from a top surface of the base 44 and is of a ring shape. The levers 50 are placed next to the fulcrum 45 to contact with and use the fulcrum 45 as a rotation center thereof. The lever 50 connects with the driving unit 20 and the diaphragm 30 at two ends thereof and transmits vibration wave from the driving unit 20 to the diaphragm 30. The length of the lever 50 from the fulcrum 45 to the diaphragm 30 is adjusted to be longer than the length from the fulcrum 45 to the driving unit 20 for increasing the vibration stroke of the diaphragm 30 during transmitting the vibration wave, so as to increase the ability of pressurizing surrounding medium without increasing the surface area of the diaphragm 30 or the depth of the driving unit 20. So the electro-acoustic transducer 10 in this invention can satisfy both the requirements of good performance and miniaturized size. For the convenience of the following description, the section of the lever 50 from the fulcrum 45 to the diaphragm 30 will be designated as the load arm 51, and the section from the fulcrum 45 to the driving unit 20 will be designated as the effort arm 52 in the following description.

In this embodiment, the driving unit 20 includes a U-shaped bottom plate 21 fixed to the frame 40, a field magnet 22 placed inside the bottom plate 21, a washer 23 placed at the bottom of the field magnet 22 to clamp the field magnet 22, and a voice coil 24 movably mounted between the washer 23 and the bottom plate 21 and connected with an external signal source. The radius of the washer 23 is smaller than the radius of the bottom plate 21, so a cylindrical gap 25 is formed between the washer 23 and the bottom plate 21, and the voice coil 24 is axially movable along the cylindrical gap 25. When a signal current is applied to the voice coil 24, a magnetic force is generated with interact of the voice coil 24 and the field magnet 22 to vibrate the voice coil 24.

Because the driving unit 20 is connected with the diaphragm 30 by means of the lever 50, so the vibration generated by the driving unit 20 can be transmitted to the diaphragm 30 through the lever 50. Besides, the lever 50 is rotated around the contact point with the fulcrum 45, so the amplitude of vibration (vibration stroke) of each point on the lever 50 is proportional to the distance from the contact point to the fulcrum 45. According to the foregoing description, it is known that the length of the load arm 51 is adjusted to be longer than the length of the effort arm 52, so the amplitude of the vibration is enlarged during transmitting the vibration wave by the lever 50, and the magnification is equal to the length proportion of the load arm 51 and the effort arm 52.

Figure 4:
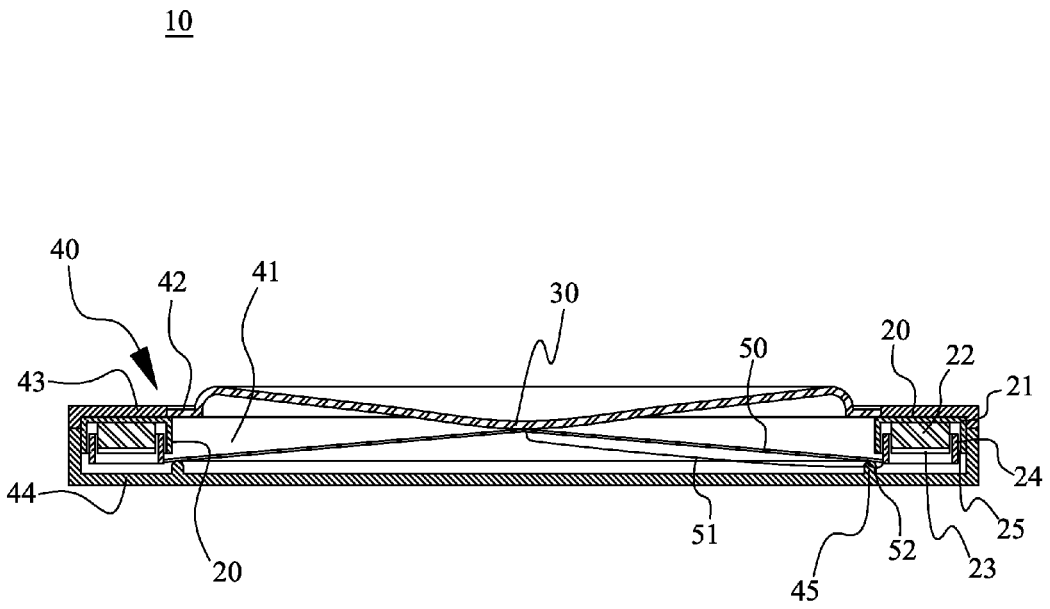
FIG. 4 and FIG. 5 show the actuation schematic diagrams of the electro-acoustic transducer in this invention.
Figure 5:
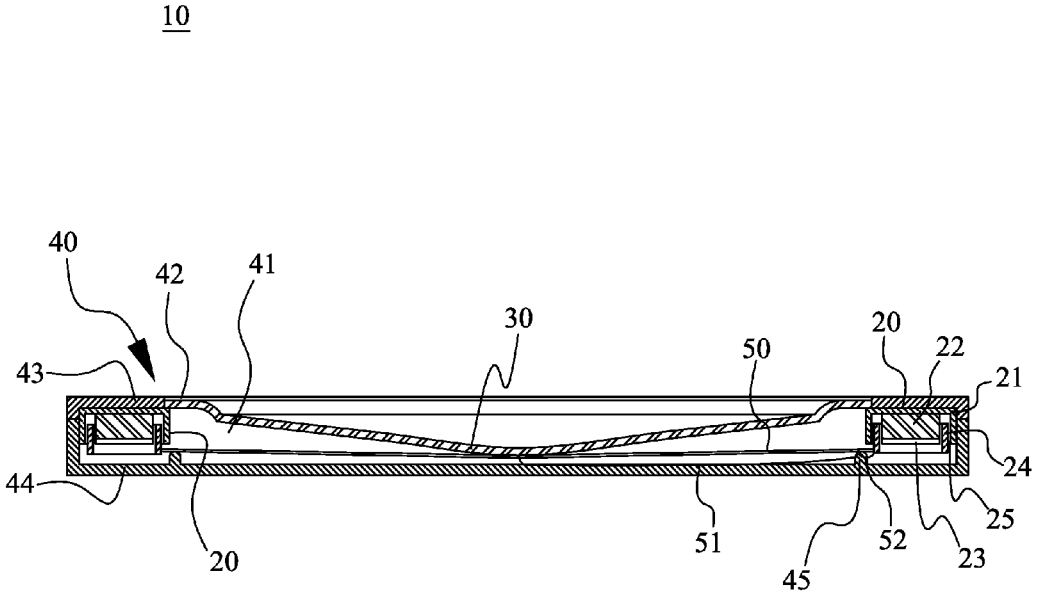

Referring to FIG. 4 and FIG. 5, the driving unit 20 in FIG. 4 extends downward and forces the diaphragm 30 to rise up. Because the load arm 51 is longer than the effort arm 52 in length, the diaphragm 30 will rise greatly when the driving unit 20 extends downward.

And in FIG. 5, the driving unit 20 shrinks upward and forces the diaphragm 30 to move down. Because the load arm 51 is longer than the effort arm 52, the diaphragm 30 will move down greatly when the driving unit 20 shrinks upward.

As described above, the electro-acoustic transducer 10 in this invention connects the driving unit 20 and the diaphragm 30 by means of the lever 50, and increases the vibration stroke of the diaphragm 30 by adjusting the proportion of the load arm 51 and the effort arm 52 to make the load arm 51 be longer than the effort arm 52, so as to increase the ability of pressurizing surrounding medium without increasing the surface area of the diaphragm 30 and the depth of the driving unit 20. So the electro-acoustic transducer 10 in this invention can satisfy both the requirements of good performance and miniaturized size.

What is claimed is:

1. An electro-acoustic transducer, comprising:

a frame with an accommodating space defined therein and an opening opened in a top surface thereof;

at least one driving unit equipped in the accommodating space of the frame;

a diaphragm movably mounted at the opening of the frame;

at least one fulcrum settled in the accommodating space of the frame; and at least one lever placed next to the fulcrum to contact with and use the fulcrum as rotation center thereof, the lever connecting with the driving unit and the diaphragm at two ends thereof and transmitting vibration wave from the driving unit to the diaphragm, the lever having a longer length from the fulcrum to the diaphragm than from the fulcrum to the driving unit for increasing the vibration stroke of the diaphragm during transmitting the vibration wave;

wherein the driving unit includes a U-shaped bottom plate fixed to the frame, a field magnet placed inside the bottom plate, a washer placed at the bottom of the field magnet to clamp the field magnet, and a voice coil movably mounted between the washer and the bottom plate and connected with an external signal source, the radius of the washer is smaller than the radius of the bottom plate, so a cylindrical gap is formed between the washer and the bottom plate, and the voice coil is axially movable along the cylindrical gap.

2. The electro-acoustic transducer as claimed in claim 1, wherein the frame includes a base and a cover matched with each other to define the accommodating space inside the frame.

3. The electro-acoustic transducer as claimed in claim 2, wherein two driving units are equipped at two opposite sides of the accommodating space and connected with an external signal source.

4. The electro-acoustic transducer as claimed in claim 3, wherein the fulcrum is of a ring shape.

5. The electro-acoustic transducer as claimed in claim 4, wherein the fulcrum is protruded upward from a top surface of the base.

* * * * *